US009957016B2

(12) United States Patent
Grimaldi

(10) Patent No.: US 9,957,016 B2
(45) Date of Patent: May 1, 2018

(54) BALCONY WITH FOLDAWAY BARRIER, IN PARTICULAR FOR BOATS

(71) Applicant: OPACMARE S.r.l., Rivalta di Torino (IT)

(72) Inventor: Michele Grimaldi, Turin (IT)

(73) Assignee: OPACMARE S.r.l., Rivalta di Torino (IT)

( * ) Notice: Subject to any disclaimer, the term of this patent is extended or adjusted under 35 U.S.C. 154(b) by 0 days. days.

(21) Appl. No.: 15/342,162

(22) Filed: Nov. 3, 2016

(65) Prior Publication Data

US 2017/0137090 A1 May 18, 2017

(30) Foreign Application Priority Data

Nov. 17, 2015 (IT) ..... 102015000073306

(51) Int. Cl.

| | |
|---|---|
| ***B63B 17/00*** | (2006.01) |
| ***B63B 17/04*** | (2006.01) |
| ***B63B 23/48*** | (2006.01) |
| *B63B 3/48* | (2006.01) |

(52) U.S. Cl.

CPC ..... *B63B 17/04* (2013.01); *B63B 23/48* (2013.01); *B63B 2003/485* (2013.01); *B63B 2017/045* (2013.01)

(58) Field of Classification Search

CPC ... B63B 17/04; B63B 23/48; B63B 2003/485; B63B 2017/045

See application file for complete search history.

(56) References Cited

U.S. PATENT DOCUMENTS 3,677,600 A * 7/1972 Charron ..... B60P 3/341 296/170
4,090,585 A * 5/1978 Laub ..... A62B 5/00 182/113

(Continued)

FOREIGN PATENT DOCUMENTS

| | | |
|---|---|---|
| EP | 1854715 A1 | 11/2007 |
| EP | 2305553 A1 | 4/2011 |
| EP | 2332820 A1 | 6/2011 |

OTHER PUBLICATIONS

Italian Search Report and Written Opinion for IT UB20155670 dated Apr. 21, 2016.

*Primary Examiner* — Anthony D Wiest
(74) *Attorney, Agent, or Firm* — Arent Fox LLP

(57) ABSTRACT

A foldaway balcony that includes a vertical support, a platform structure tiltably mounted to the vertical support and a barrier structure mounted on the platform structure. The platform structure includes a support structure and a floor structure which are tiltable separately from one another relative to the vertical support. The barrier structure includes barrier elements, hinged at the edge of the platform structure, and tiltable between a stowed position in which they lie inside the support structure, and a deployed position, in which they stand up relative to the support structure. A barrier element, connected to a distal side of the edge of the platform structure includes a first and a second pair of stanchions hinged to the distal side, a first and a second rod which interconnect the upper ends of the stanchions, and a handrail with parallel guides, in which are housed the first and the second rods.

4 Claims, 12 Drawing Sheets

(56) References Cited

U.S. PATENT DOCUMENTS

| | | | | |
|---|---|---|---|---|
| 8,365,472 | B2 * | 2/2013 | Grimaldi | B63B 17/04<br>114/362 |
| 2008/0296922 | A1 * | 12/2008 | Diamond | B60P 3/34<br>296/26.13 |

* cited by examiner

BALCONY WITH FOLDAWAY BARRIER, IN PARTICULAR FOR BOATS

CROSS REFERENCE TO RELATED APPLICATIONS

The present application claims priority to Italian Patent Application No. 102015000073306, filed Nov. 17, 2015, the entire contents of which are incorporated herein by reference.

FIELD OF THE INVENTION

The present invention refers to a foldaway balcony, of the type comprising a vertical support and a platform structure tiltably mounted on the vertical support, said platform structure being able to assume a closed position in which it is arranged substantially aligned with the vertical support, and an open position in which it is arranged cantilevered from the vertical support, and further comprising a barrier structure mounted on the platform structure, wherein said platform structure comprises a box-like support structure and a planar floor structure which are tiltable separately from one another relative to the vertical support; and said barrier structure comprises a plurality of barrier elements, said barrier elements being hinged at the edge of said support structure of the platform structure, and being tiltable between a stowed position in which they lie inside the support structure, and a deployed position, in which they stand up relative to the support structure.

BACKGROUND OF THE INVENTION

A balcony of this type is described in the publication EP 2332820 A1 by the same applicant.

Balconies of foldaway type are in particular installed on luxury boats.

A problem which is encountered in the design of foldaway balconies attached to the sidewalls of boats consists in the fact that, sometimes, the extension in depth of the platform structure is not sufficient to allow the housing of sufficiently high barrier elements connected to the distal side of the platform structure. In EP 2332820 A1 this problem was resolved by proposing telescopically extendable stanchions, which are retracted in order to be able to be stowed within the platform structure. This expedient constitutes a complication from the point of view of the mechanization of the structure, since a dedicated actuating mechanism is required in order to extend/retract the stanchions.

SUMMARY OF THE INVENTION

An object of the present invention is therefore to make available a foldaway balcony which makes it possible to house, within the platform structure, stanchions of suitable height, which however do not entail complications from the point of view of their actuation.

In view of this purpose, an object of the invention consists of a foldaway balcony of the type defined at the beginning, wherein at least one of the barrier elements, connected to a distal side of the edge of the support structure of the platform structure comprises a first and a second pair of stanchions hinged to the distal side of the edge of the support structure, a first and a second rod that interconnect the upper ends of the stanchions respectively of the first and second pair, and are hinged thereto, and a handrail within which a pair of parallel guides are formed, in which the first and the second rod respectively are slidably housed.

In the balcony according to the invention, the stowing of the barrier element connected to the distal side of the platform structure takes place in practice solely in a vertical plane, as a result of the articulated parallelograms formed by the two pairs of stanchions with the respective rods and the edge of the platform structure. Consequently, the height of the stanchions is no longer constrained by the dimensions in depth of the platform structure (as happened in EP 2332820 A1), but at most by its dimensions in width, which are generally more capacious than its dimensions in depth.

Preferred embodiments of the invention are defined in the dependent claims, which are to be understood as an integral part of the present description.

BRIEF DESCRIPTION OF THE DRAWINGS

Further characteristics and advantages of the device according to the invention will become clearer with the detailed description which follows of an embodiment of the invention, made with reference to the attached drawings, provided purely by way of non-limiting illustration, in which.

DETAILED DESCRIPTION OF THE PREFERRED EMBODIMENTS

Figure 1:
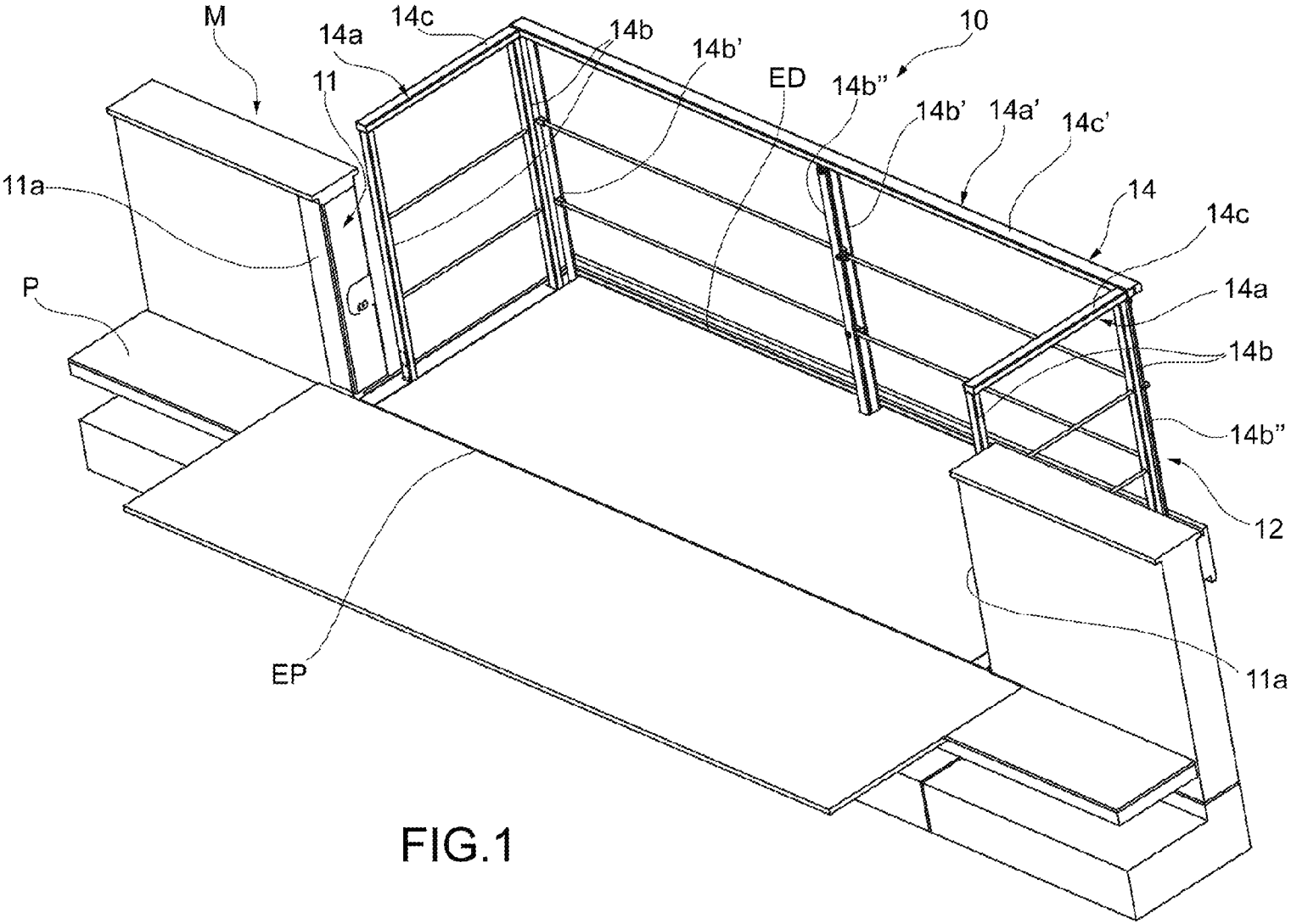
FIG. 1 is a rear perspective view of a foldaway balcony according to the invention, connected to a sidewall of a boat.
Figure 2A:
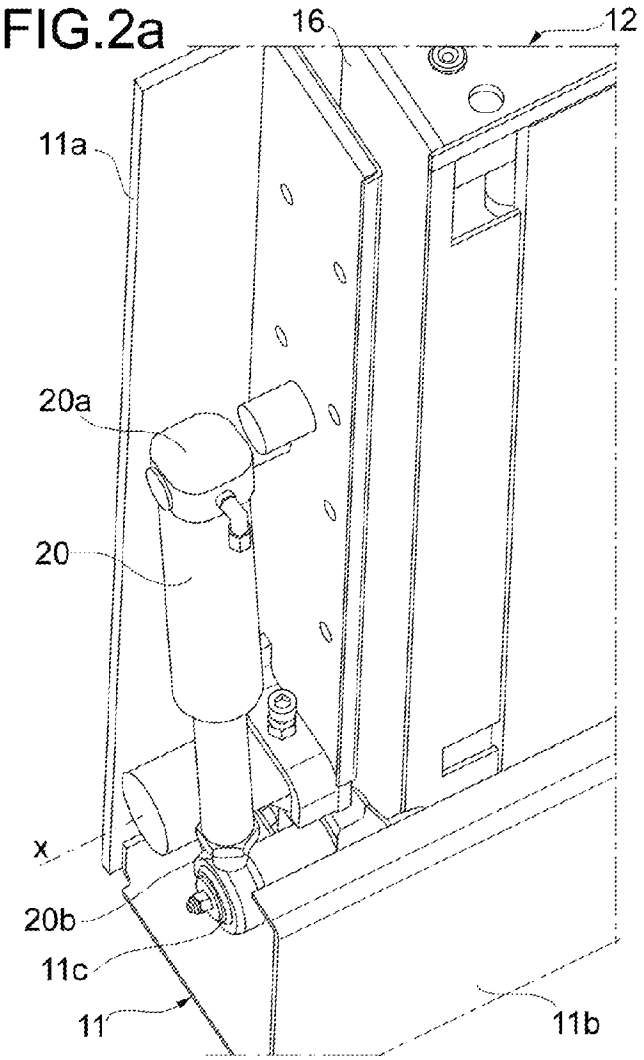
FIGS. 2*a* and 2*b* are cutaway perspective views of an upright of the balcony of FIG. 1, respectively in a closed and an open position of the balcony.
Figure 2B:
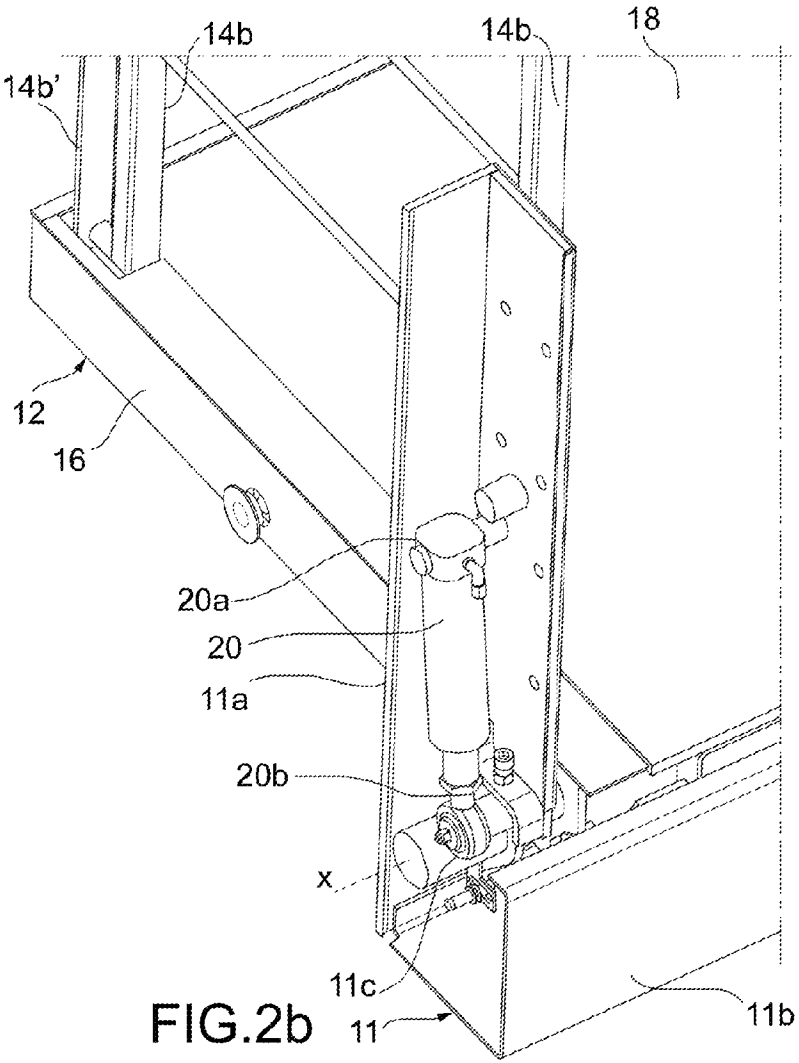
Figure 3B:
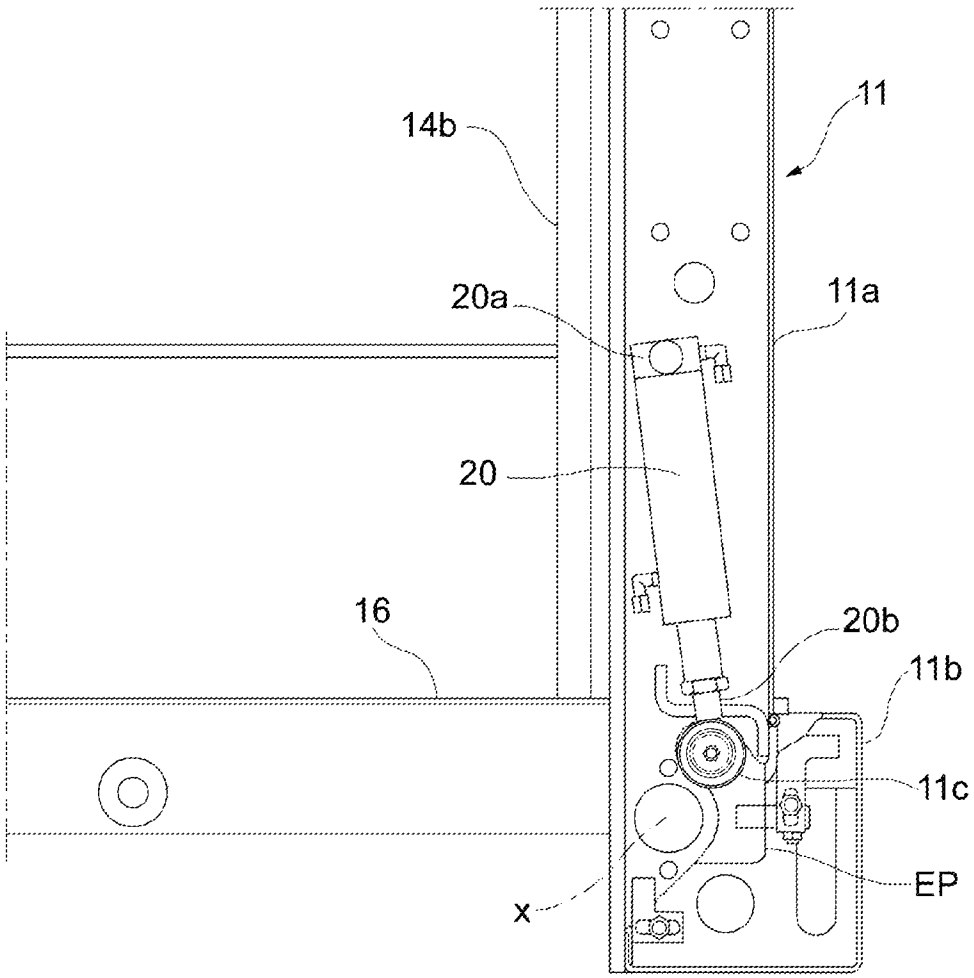
FIGS. 3*a* and 3*b* are views in section of the upright, corresponding respectively to FIGS. 2*a* and 2*b;*
Figure 3A:
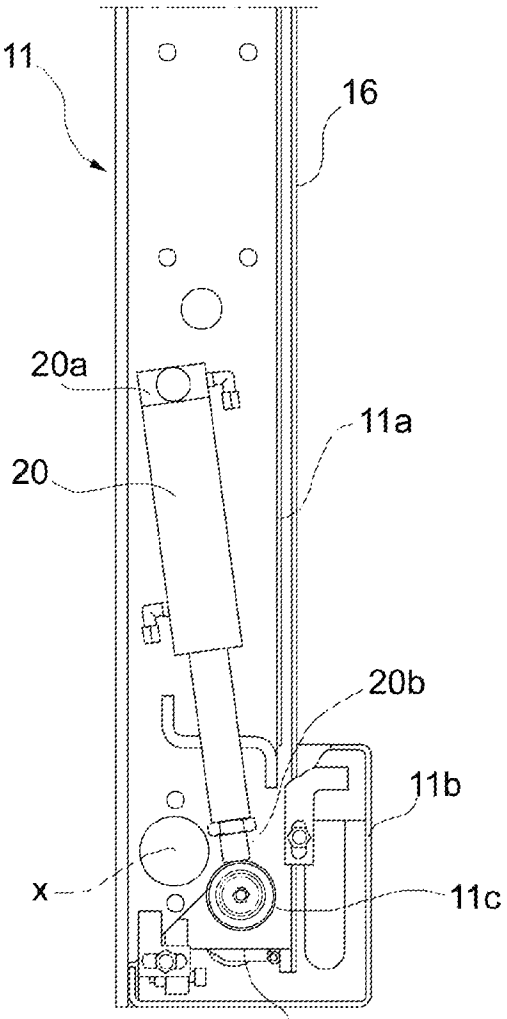
Figure 5:
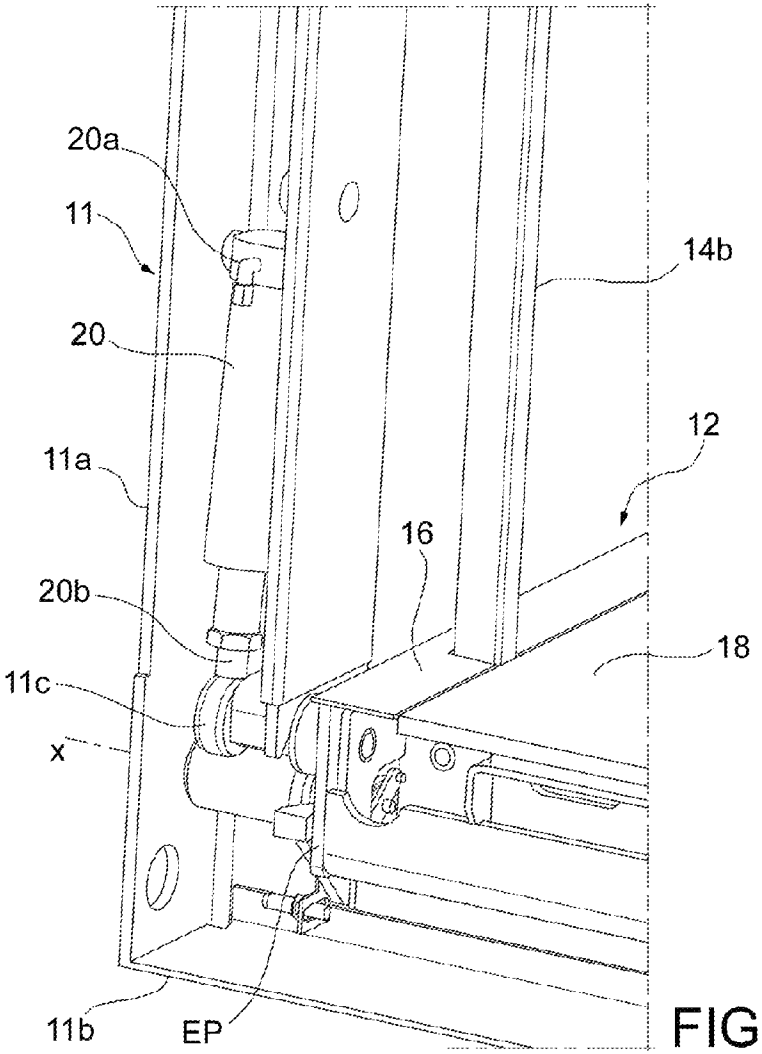
FIGS. 4 and 5 are perspective views of the upright, corresponding respectively to FIGS. 2*a* and 2*b*, taken from another angle.
Figure 4:
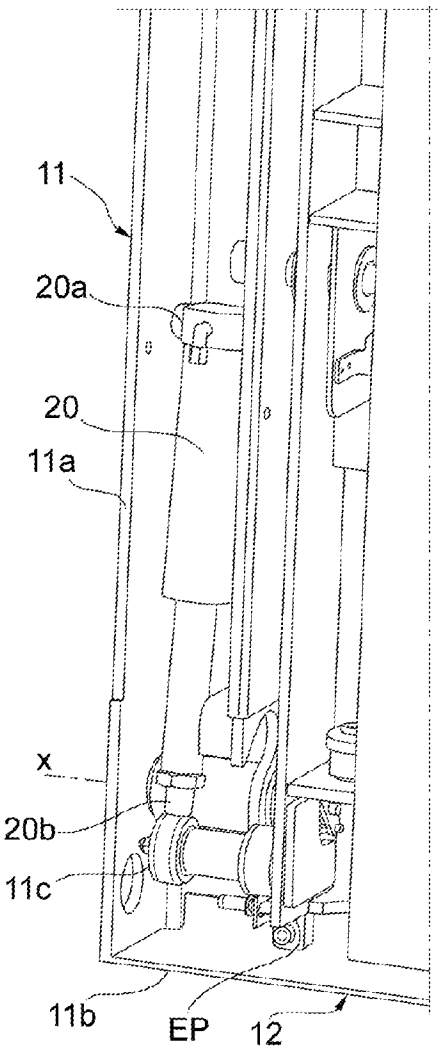

With reference to FIG. 1, a foldaway balcony is shown according to the invention, comprehensively indicated by 10. Balconies of this type are in particular installed on luxury boats. The drawings refer specifically to this type of application, and show the balcony 10 installed on a sidewall M of a boat. In FIG. 1, an internal floor P of the boat is also shown, with respect to which the floor of the balcony is substantially on a level when the balcony is in the open position. Naturally, the invention is not limited to this example of installation, being applicable more generally to a substantially vertical wall of a fixed or mobile structure.

As is shown more clearly in FIGS. 2*a* to 6, the balcony 10 comprises a vertical support 11 fixed to the sidewall M and a platform structure 12 tiltably mounted to the vertical support 11. The vertical support 11 comprises a pair of uprights 11*a* connected to each other by a transverse base element 11*b*. The platform structure 12 is capable of assuming a closed position (not illustrated), in which it is arranged substantially aligned with the vertical support 11 and therefore with the sidewall M, and an open position, in which it is arranged cantilevered from the vertical support 11 and the sidewall M (see for example FIG. 1). In the closed position the platform structure 12 in fact constitutes a part of the sidewall itself, without loss of continuity with the surrounding wall. In the open position, because of the lowering of the platform structure 12, a gap is created in the sidewall M which allows access to the balcony from the inside of the boat, and vice versa.

The balcony 10 comprises furthermore a barrier structure 14 mounted on the platform structure 12.

Figure 6:
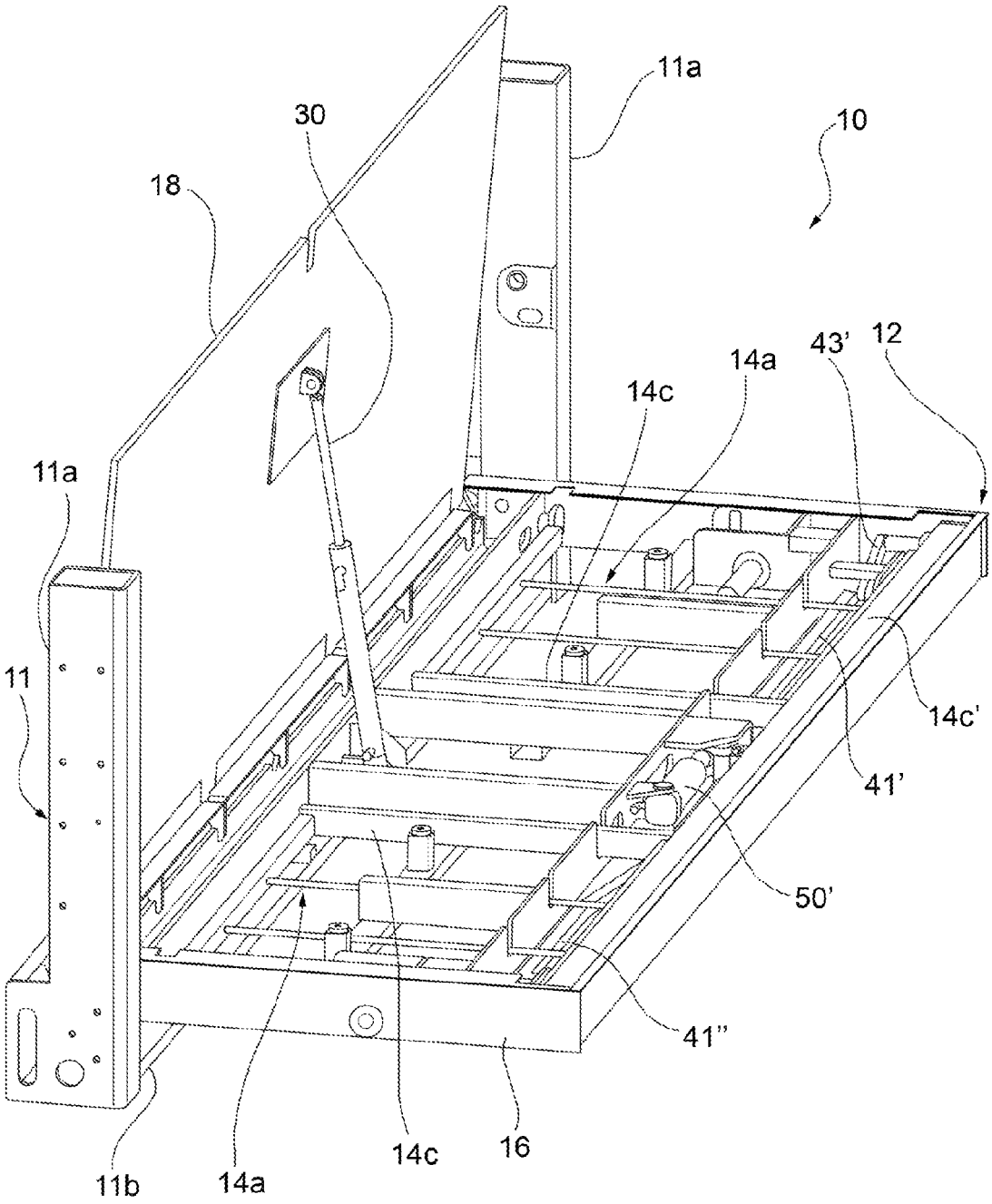
FIG. 6 is a perspective view of the balcony of FIG. 1, shown with a lowered platform structure and a raised floor structure.
Figure 7:
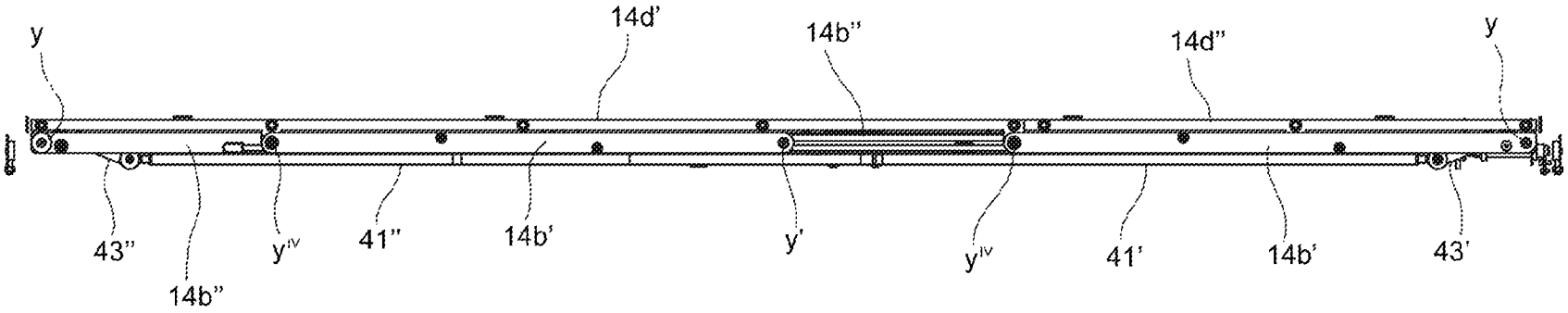
FIG. 7 is a view in frontal elevation of a barrier structure of the balcony of FIG. 6, shown in a stowed condition.
Figure 8:
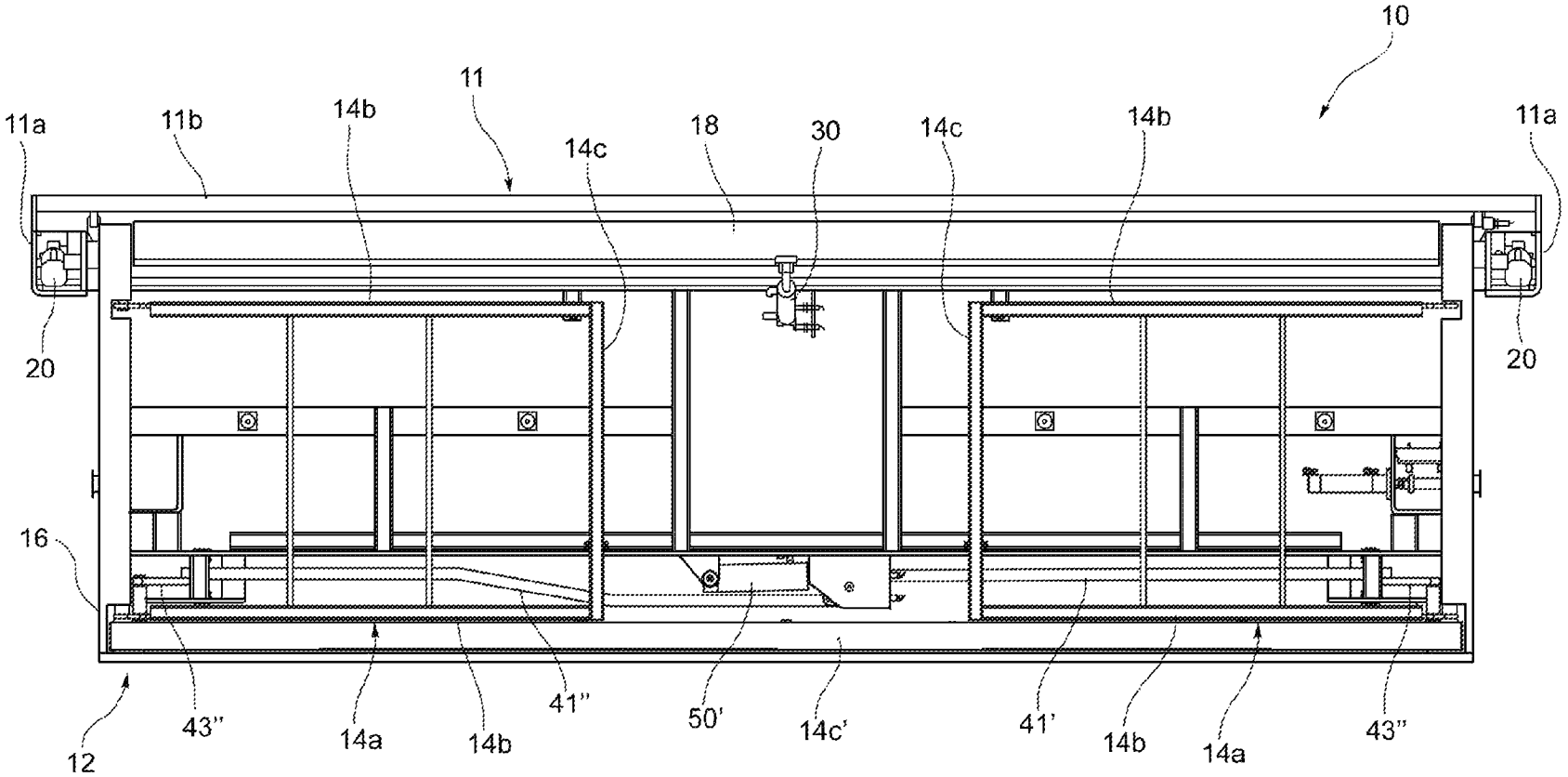
FIG. 8 is a view on plan of the balcony of FIG. 6.

With reference to FIG. 6, the platform structure 12 comprises a box-shaped support structure 16 and a floor structure 18 of planar form. The support structure 16 and the floor structure 18 are tiltable separately from each other with respect to the vertical support 11 and the sidewall M. The axes of hinging of these structures are substantially parallel to the sidewall M. In particular, the hinging axis of the support structure 16 is indicated by x in the drawings. EP and ED, on the other hand, indicate the proximal end and the distal end of the platform structure 12.

Platform structure 12 is thus connected to a tilting system to tilt the platform structure 12 between the closed and the open position.

For tilting the support structure 16 the tilting system comprises at least one linear actuator 20 housed inside at least one of the uprights 11*a* of the vertical support 11, as shown in FIGS. 2*a*-5. In the example illustrated, the linear actuator 20 consists of a hydraulic cylinder.

The linear actuator 20 comprises one end 20*a* on the upright side 20*a*, hinged to the upright 11*a* of the vertical support 11, and one end 20*b* on the platform side, which bears on a pin 11*c* integral with the support structure 16. The pin 11*c* is located between the hinging axis x and the proximal end EP of the platform structure 12.

The pin 11*c* thus constitutes an application point for the force exerted by the linear actuator 20 on the platform structure 12, in particular on the support structure 16.

For tilting the floor structure 18, the tilting system comprises at least one linear actuator 30 (shown in FIG. 6), for example a hydraulic cylinder, which comprises one end on the base side hinged to the transverse element 11*b* of the vertical support 11, and one end on the floor side hinged to the floor structure 18.

The barrier structure 14 comprises a plurality of barrier elements 14*a*, which are hinged to the edge of the platform structure 12. In the example illustrated there are three distinct barrier elements 14*a*, 14*a*', respectively connected to the three exposed sides of the balcony. Each barrier element 14*a*, 14*a*' is tiltable between a stowed position (see FIG. 6), in which it lies inside the support structure 16, and a deployed position in which it stands up relative to the support structure 16 (see FIGS. 1 and 11).

Each of the barrier elements 14*a* connected to the lateral sides of the edge of the support structure 16 essentially comprises two stanchions 14*b*, hinged to the edge of the support structure 16, and a handrail 14*c* extending between these uprights 14*b*. These barrier elements 14*a* have respective tilting axes y parallel to the lateral sides of the balcony (see FIG. 9).

Figure 13:
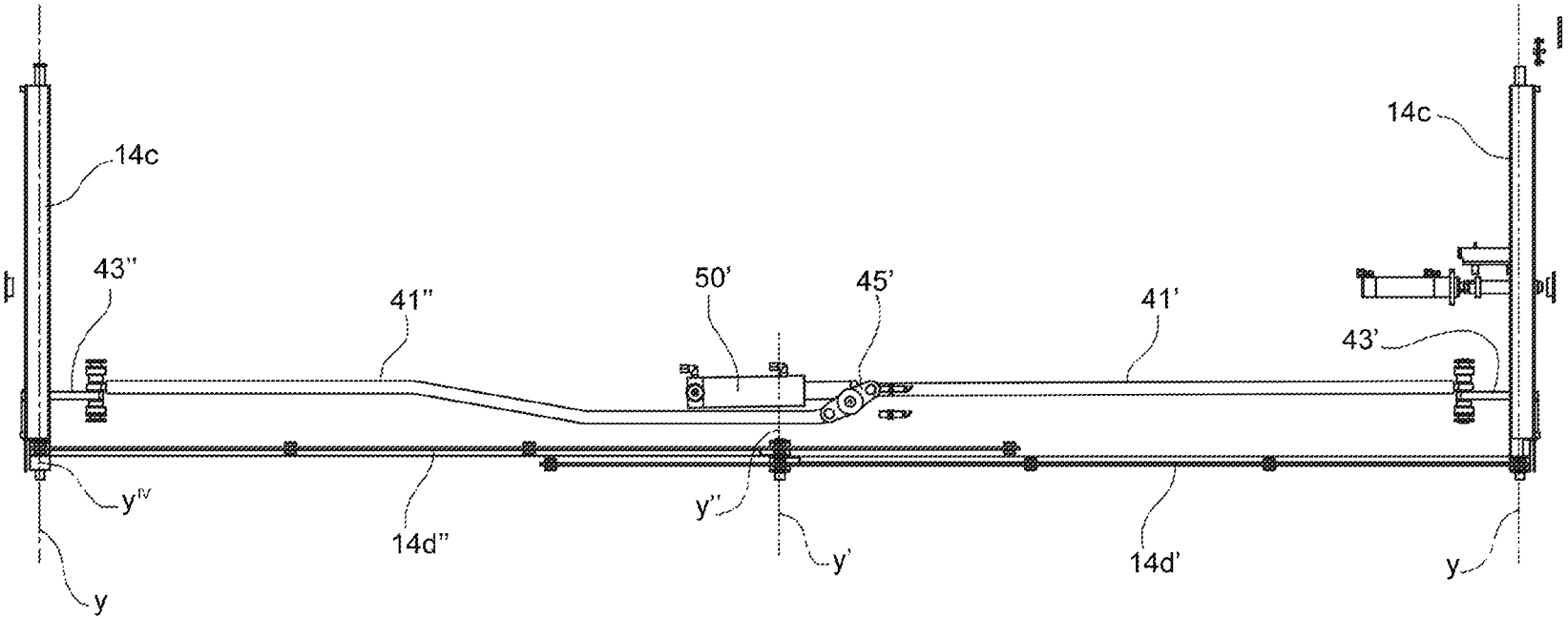
FIG. 13 is a view on plan of the barrier structure of the balcony of FIG. 8.

The barrier element 14*a*' connected to the distal side ED of the platform structure 12 comprises a first and a second pair of stanchions 14*b*', 14*b*" hinged to the distal side ED of the edge of the support structure 16. These stanchions 14*b*', 14*b*" have respective hinging axes perpendicular to the distal side ED of the balcony. The two pairs of stanchions 14*b*', 14*b*" are arranged offset with respect to the direction of the depth of the platform structure 12, and the laterally innermost stanchions 14*b*', 14*b*" of the two pairs are arranged with their respective hinging axes y', y" aligned with each other. The barrier element 14*a*' further comprises a handrail 14*c*', and a first and a second rod 14*d*', 14*d*" (visible in FIG. 13) which interconnect the upper ends of the stanchions 14*b*' and 14*b*" respectively of the first and the second pair. The first and the second rod 14*d*', 14*d*" are hinged at the upper ends of the stanchions 14*b*' and 14*b*" respectively of the first and the second pair. The hinging axes of the first rod 14*d*' at the upper ends of stanchions 14*b*' are indicated by $y'^{v}$, while the hinging axes of the second rod 14*d*" at the upper ends of stanchions 14*b*" are indicated by $y^{v}$. Inside the handrail 14*c*' there is formed a pair of parallel guides, in which are slidably housed respectively the first and the second rod 14*d*', 14*d*".

The two pair of stanchions 14*b*', 14*b*" with the respective rods 14*d*', 14*d*" and the edge of the support structure 16 thus form two articulated parallelograms which allow the handrail 14*c*' to move vertically when the stanchions 14*b*', 14*b*" rotate around their respective axes.

Each of the barrier elements 14*a* connected to the lateral sides of the platform structure 16 is arranged integrally with the laterally outermost stanchion respectively of the first and the second pair of stanchions, by rigidly connecting elements. Consequently, the axes of rotation of the laterally outermost stanchions 14*b*', 14*b*" of the first and second pair of stanchions coincide with the axes of rotation y of the barrier elements 14*a* connected to the lateral sides of the platform structure 12.

Figure 9:
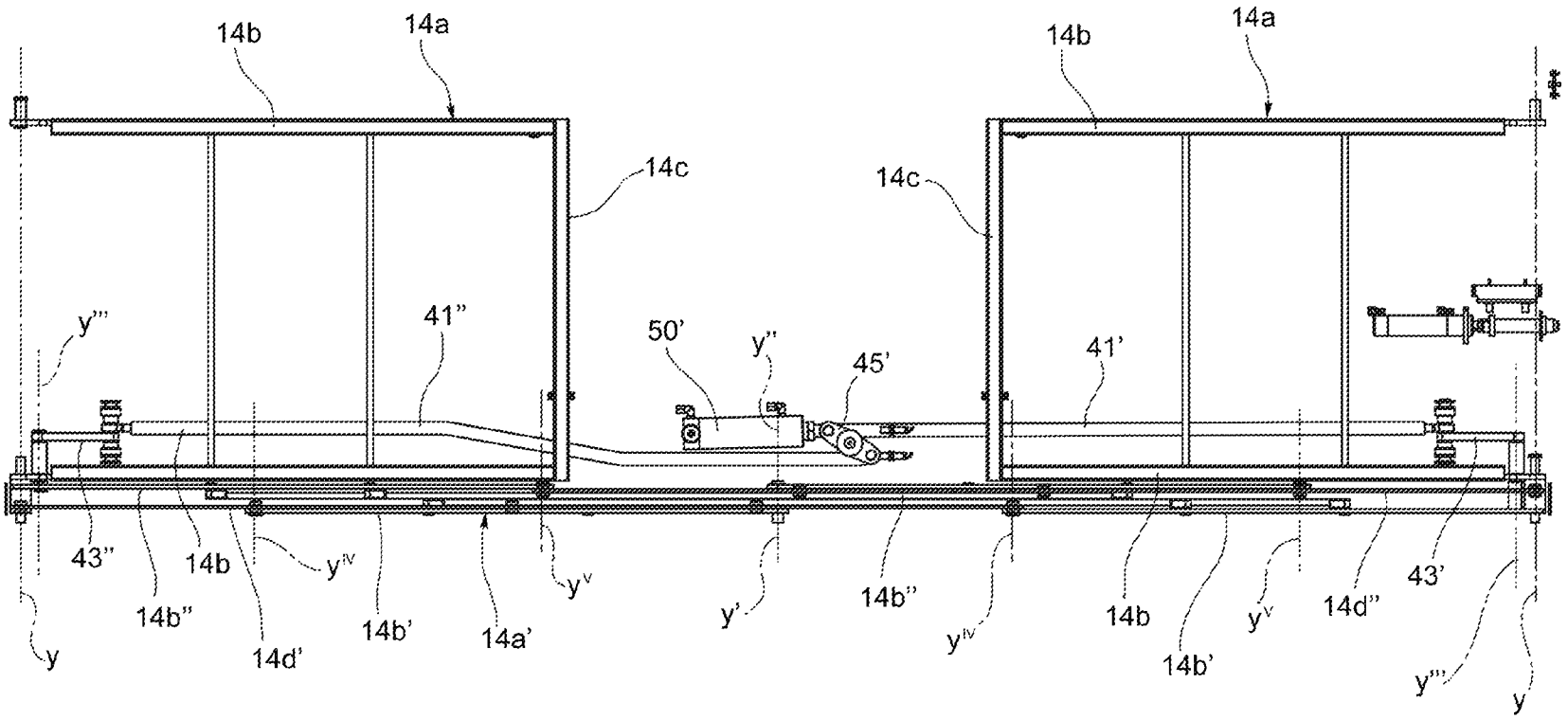
FIG. 9 is a view on plan of the barrier elements of the balcony of FIG. 8.
Figure 10:
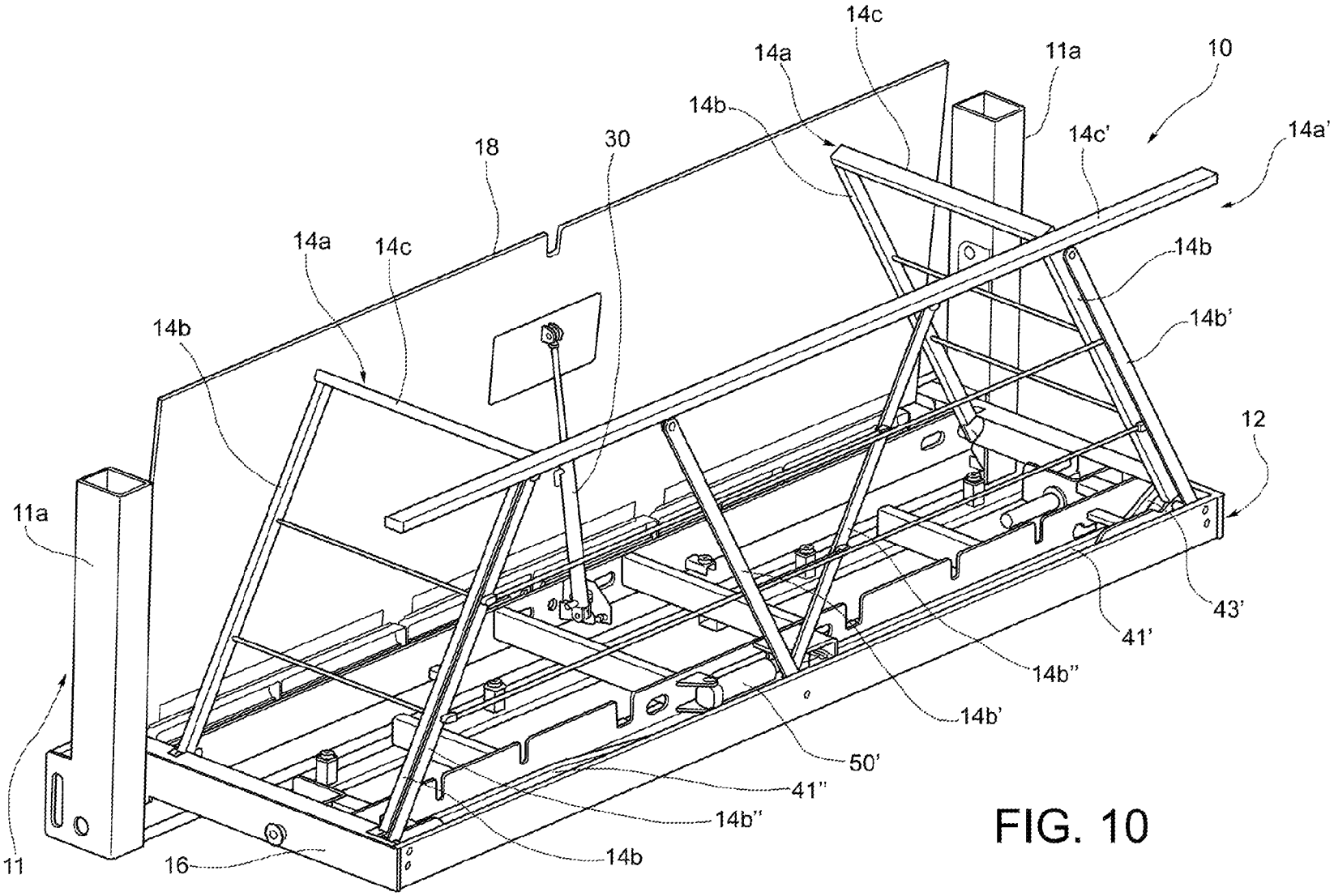
FIG. 10 is a perspective view of the balcony corresponding to that of FIG. 6, in which the barrier structure is shown in a partially deployed position.

With reference to FIG. 9, the balcony thus comprises a barrier tilting system arranged inside the support structure 16 of the platform structure 12, which includes, for each pair of stanchions 14*b*', 14*b*", an actuating rod 41', 41" constrained to slide along a rectilinear path, and a connecting rod 43', 43" hinged at one end to the actuating rod 41', 41", and at the other end to a hinging point y"' integral with the laterally outermost stanchion of the pair, and spaced apart from the hinging axis y of said stanchion. In the example illustrated, each connecting rod 43', 43" is hinged to one of the stanchions 14*b* of the barrier elements 14*a* connected to the lateral sides of the edge of the platform structure 12 which, as explained above, are integral with the laterally outermost of the first and second pair of stanchions of the barrier element 14*a*' connected to the distal side ED of the platform structure 12.

The barrier tilting system further comprises a linear actuator 50', for example a hydraulic cylinder, one movable end of which is connected to an end of one of the actuating rods 41', which is further connected, by means of a transmission lever 45', to an end of the other actuating rod 41". The two actuating rods 41', 41" are therefore movable in the opposite direction to each other.

The opening movement of the balcony 10 described above is as follows:

When the platform structure 12 is in the closed position, the linear actuator 20 whose end bears on the pin 11*c* which is integral with the platform structure is in the condition of maximum elongation.

Figure 11:
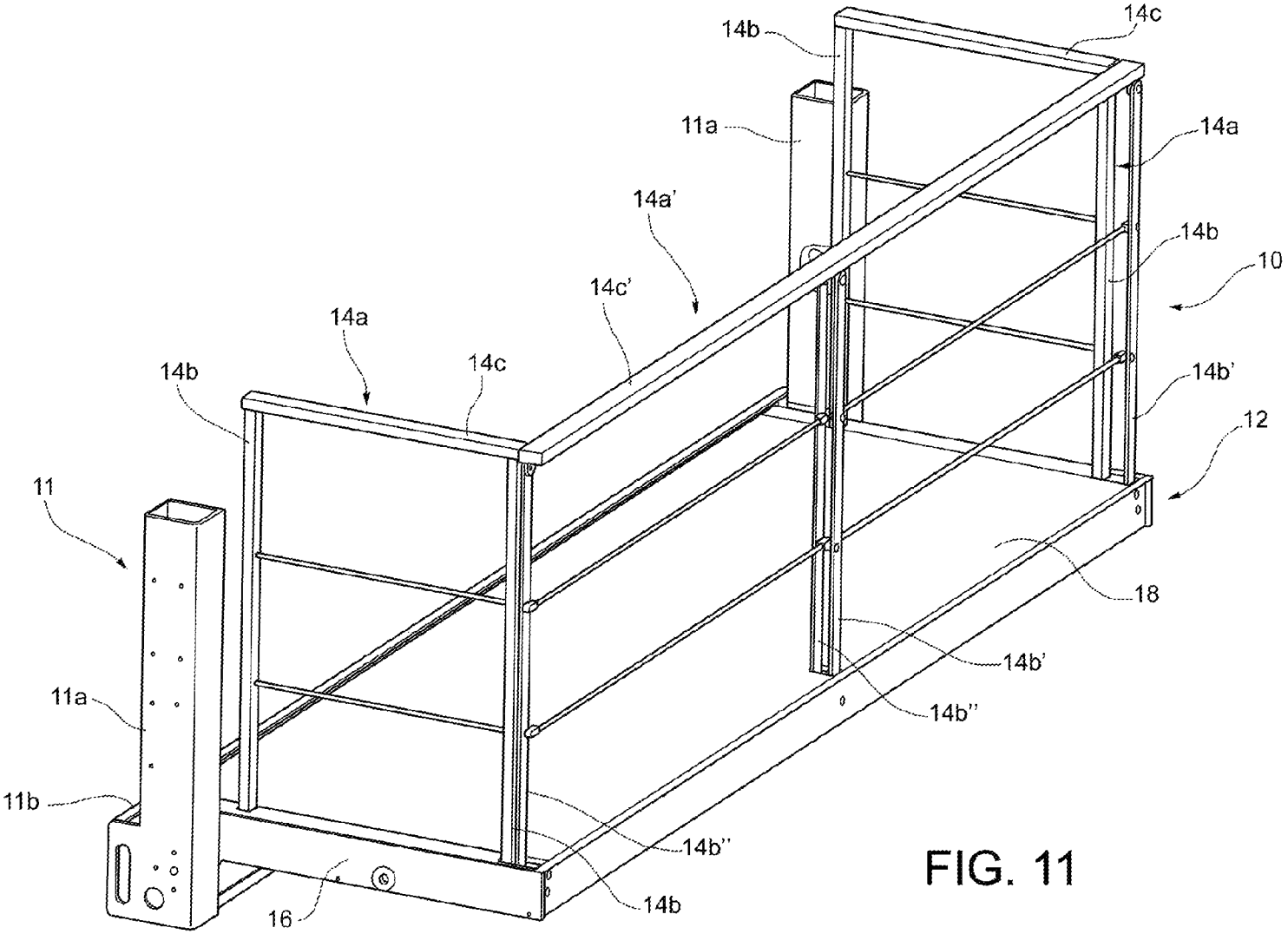
FIG. 11 is a perspective view of the balcony corresponding to that of FIGS. 6 and 10, in which the balcony is shown in a completely open position.
Figure 12:
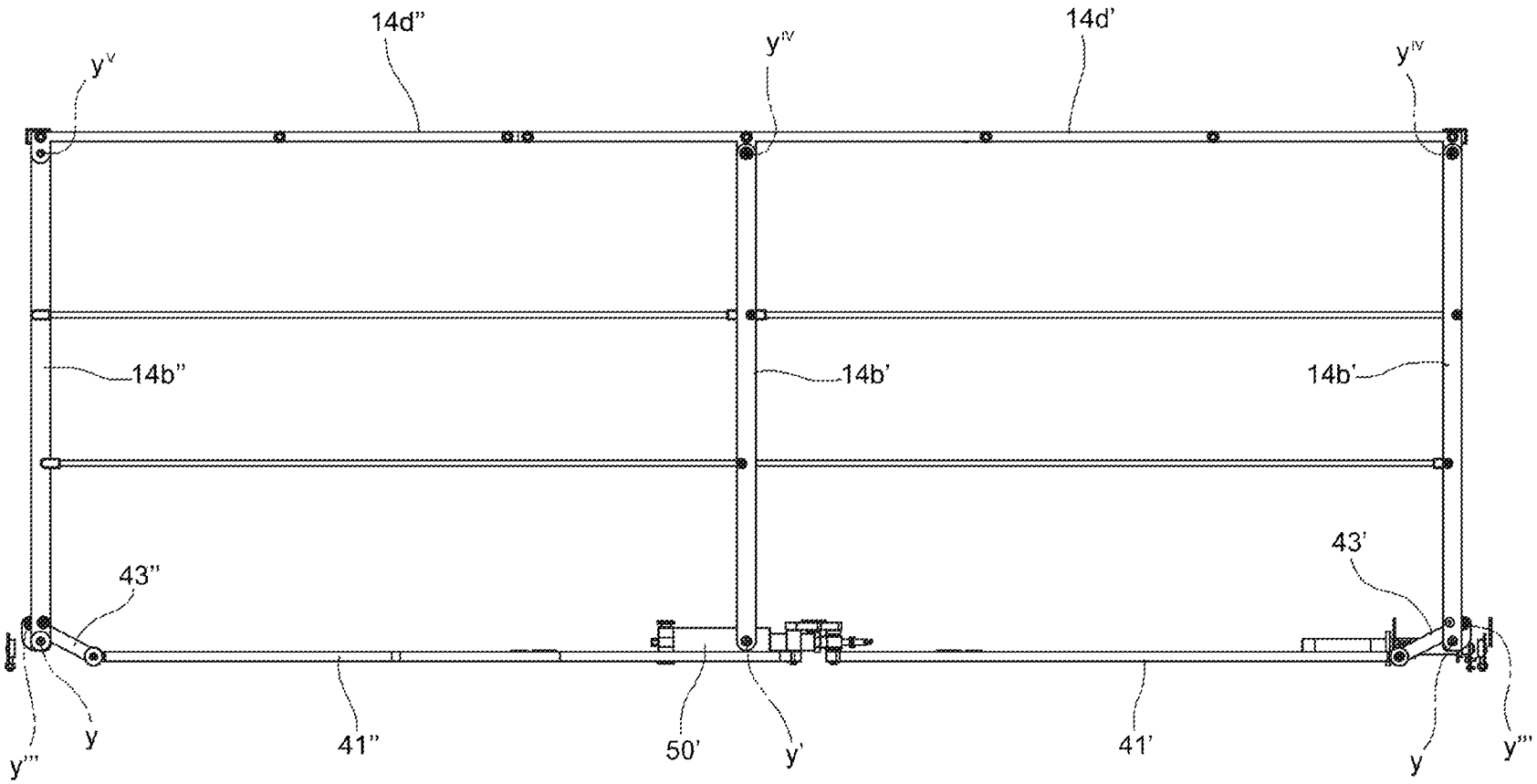
FIG. 12 is a view in frontal elevation of a barrier structure of the balcony of FIG. 11, shown in a deployed condition.

During the movement of the platform structure 12 from the closed position to the open position, the linear actuator 20 is progressively retracted and the support structure 16 is lowered as a result of the force of gravity. Initially, therefore, there is a tilting of the support structure 16 (containing the barrier elements 14*a*, 14*a*'), which will stop once it has reached its final opening position (FIG. 6). The floor structure 18 remains initially aligned with the inner side of the sidewall M. At the end of the movement of the support structure 16, i.e. when there is sufficient room to avoid interference with the platform structure 18, the barrier elements 14*a*, 14*a*' are actuated by means of the linear actuator 50' of the barrier tilting system, so that the barrier elements move from the stowed position to the deployed position. At the end of the deployment of the barrier elements 14*a*, 14*a*', the floor structure 18, which stops by finally closing against the support structure 16 (FIG. 11).

It is to be understood that the invention is not limited to the embodiment here described and illustrated: it is, on the contrary, capable of modification relating to form and arrangement of parts, construction details and operation, according to the numerous possible variants which will seem opportune to persons skilled in the sector, and which are to be understood as comprised within the scope of the invention, as defined by the claims which follow.

What is claimed is:

1. A foldaway balcony, comprising a vertical support and a platform structure tiltably mounted on the vertical support, said platform structure being able to assume a closed position in which it is arranged substantially aligned with the vertical support, and an open position in which it is arranged cantilevered from the vertical support, and further comprising a barrier structure mounted on the platform structure, wherein said platform structure comprises a box-like support structure and a planar floor structure which are tiltable separately from one another relative to the vertical support; and said barrier structure comprises a plurality of barrier elements, said barrier elements being hinged at an edge of said support structure of the platform structure, and being tiltable between a stowed position in which they lie inside the support structure, and a deployed position in which they stand up relative to the support structure;

wherein at least one of the barrier elements, connected to a distal side of the edge of the support structure of the platform structure, comprises a first and a second pair of stanchions hinged to a distal side of the edge of the support structure, a first and a second rod that interconnect upper ends of the stanchions of the first and second pair, respectively, and are hinged thereto, and a handrail within which a pair of parallel guides are formed, in which the first and the second rod, respectively, are slidably received.

2. The foldaway balcony according to claim 1, wherein barrier elements connected to lateral sides of the edge of the support structure of the platform structure have respective tilting axes parallel to the lateral sides of the edge of the support structure, and are arranged fixed to one of the stanchions, respectively of the first and the second pair.

3. The foldaway balcony according to claim 1, further comprising a barrier tilting system arranged within the support structure of the platform structure, which includes, for each pair of stanchions, an actuating rod constrained to slide along a rectilinear path and a connecting rod hinged at one end to the actuating rod, and at the other end to a hinging point integral with the stanchion which is the laterally outermost of the pair, and spaced apart from a tilting axis of said stanchion.

4. The foldaway balcony according to claim 3, wherein the barrier tilting system further comprises a linear actuator, a movable end of which is connected to an end of a first actuating rod that is further connected, by means of a transmission lever, to an end of a second actuating rod movable in opposite direction relative to the first actuating rod.

* * * * *